US010947780B2

(12) United States Patent
Lai

(10) Patent No.: US 10,947,780 B2
(45) Date of Patent: Mar. 16, 2021

(54) STOP STRUCTURE FOR CORDLESS ROLLER SHADE

(71) Applicant: Chien-Feng Lai, Yuanlin (TW)

(72) Inventor: Chien-Chih Lai, Yuanlin (TW)

(73) Assignee: Chien-Feng Lai, Yuanlin (TW)

( * ) Notice: Subject to any disclaimer, the term of this patent is extended or adjusted under 35 U.S.C. 154(b) by 140 days.

(21) Appl. No.: 16/406,057

(22) Filed: May 8, 2019

(65) Prior Publication Data

US 2020/0355028 A1 Nov. 12, 2020

(51) Int. Cl.

| | |
|---|---|
| ***E06B 9/80*** | (2006.01) |
| ***E06B 9/42*** | (2006.01) |
| ***E06B 9/60*** | (2006.01) |

(52) U.S. Cl.

CPC ..... *E06B 9/80* (2013.01); *E06B 9/42* (2013.01); *E06B 9/60* (2013.01); *E06B 2009/801* (2013.01)

(58) Field of Classification Search

CPC ..... E06B 9/80; E06B 9/42; E06B 9/60; E06B 2009/801

See application file for complete search history.

(56) References Cited

U.S. PATENT DOCUMENTS

| | | | | |
|---|---|---|---|---|
| 2015/0300087 | A1* | 10/2015 | Watanabe | B60J 1/2063 160/301 |
| 2018/0106107 | A1* | 4/2018 | Smith | E06B 9/42 |
| 2019/0017321 | A1* | 1/2019 | Chen | E06B 9/50 |
| 2019/0264502 | A1* | 8/2019 | Marocco | E06B 9/50 |
| 2020/0256124 | A1* | 8/2020 | Lai | E06B 9/60 |

* cited by examiner

*Primary Examiner* — Beth A Stephan

(74) *Attorney, Agent, or Firm* — Alan D. Kamrath; Mayer & Williams PC

(57) ABSTRACT

A stop structure for a cordless curtain includes a bracket, a mounting seat, a rotation wheel, a locking piece, and a spring. The bracket has a resting portion. The mounting seat has an axle. The rotation wheel is mounted on the axle and has at least one positioning hole. The locking piece is rotatably mounted on the mounting seat and has a first end provided with a positioning projection positioned in the at least one positioning hole. A push member is biased between a second end of the locking piece and the mounting seat. When the resting portion presses the locking piece, the positioning projection is detached from the at least one positioning hole. The spring is mounted in the rotation wheel and connected with the rotation wheel and the axle.

10 Claims, 6 Drawing Sheets

STOP STRUCTURE FOR CORDLESS ROLLER SHADE

BACKGROUND OF THE INVENTION

1. Field of the Invention

The present invention relates to a stop structure and, more particularly, to a spring stop structure for a cordless curtain, such as a cordless roller shade or the like.

2. Description of the Related Art

A conventional roller shade is controlled by a pull cord. When one end of the pull cord is pulled, the roller shade is extended downward, and when the other end of the pull cord is pulled, the roller shade is wound upward. Another conventional roller shade comprises a return mechanism. When the roller shade is pulled downward to a determined position, the return mechanism stores a restoring force, and when the roller shade is wound upward, the roller shade is rolled quickly by the restoring force of the return mechanism.

A conventional cordless roller shade (or spring type roller shade) comprises a shaft, a shade member, a roller, and a coil spring. The shade member is wound around the shaft. When the shade member is moved, the shaft is rotated to rotate the roller which drives and stretch the coil spring. In operation, when the shade member is pulled downward to reach a determined position, the weight of the shade member is counteracted by the elastic force of the coil spring to form a balance state, such that the shade member stays at the determined position. In assembly, the coil spring is revolved and tightened during the assembly process, so as to store a restoring force which is directed upward to balance the weight of the shade member, and to keep the shade member at the determined position, such that when the shade member is folded, the shade member will not rotate and slip downward. However, when the cordless roller shade is disassembled for cleaning, the coil spring becomes loosened due to loss of the resistance of the shade member. Thus, it is necessary and difficult to tighten and regulate the tension of the coil spring before the cordless roller shade is assembled again, thereby causing inconvenience to the user when cleaning the cordless roller shade. In addition, when the coil spring is too tight, the shade member is driven upward and cannot be pulled downward, and when the coil spring is too loose, the shade member cannot be folded, such that the user cannot tighten and regulate the tension of the coil spring exactly.

BRIEF SUMMARY OF THE INVENTION

The primary objective of the present invention is to provide a stop (or locking) structure that prevents the spring from being loosened by a locking action when the cordless (or spring) roller shade is disassembled.

In accordance with the present invention, there is provided a stop structure comprising a bracket, a mounting seat mounted on the bracket, a rotation wheel mounted on the mounting seat, a locking piece mounted on the mounting seat, and a spring mounted on the rotation wheel. The bracket includes a fitting portion, a first retaining portion, and a resting portion. The first retaining portion of the bracket is provided with at least one first connecting end. The mounting seat is provided with a second retaining portion corresponding to the first retaining portion of the bracket. The second retaining portion of the mounting seat is provided with at least one second connecting end corresponding to and connected with the first connecting end of the bracket. The mounting seat has a first face provided with an axle and a second face provided with a receiving area. The receiving area of the mounting seat is provided with a shaft hole and a recess. The rotation wheel is mounted on the axle of the mounting seat. The rotation wheel has an interior provided with a receiving space. The rotation wheel has a first end provided with an opening connected to the receiving space. The rotation wheel is provided with a connecting area. The rotation wheel has a second end provided with an axle hole and at least one positioning hole. The axle hole of the rotation wheel is mounted on the axle of the mounting seat. The locking piece is mounted on the receiving area of the mounting seat. The locking piece is provided with a shaft rotatably mounted in the shaft hole of the mounting seat. The locking piece has a first end provided with a positioning projection positioned in the at least one positioning hole of the rotation wheel. A push member is mounted in the recess of the mounting seat and biased between a second end of the locking piece and the mounting seat. When the resting portion of the bracket presses the locking piece, the positioning projection of the locking piece is detached from the at least one positioning hole of the rotation wheel. The spring is mounted in the receiving space of the rotation wheel. The spring has a first end provided with a first connecting portion connected with the connecting area of the rotation wheel and a second end provided with a second connecting portion connected with the axle of the mounting seat.

According to the primary advantage of the present invention, the rotation wheel is locked automatically when the mounting seat is detached from the bracket, to prevent the rotation wheel from being rotated, and to prevent the spring from becoming loosened when the cordless roller shade is disassembled, such that it is unnecessary to tighten and regulate the tension of the spring when the mounting seat is mounted on the bracket.

According to another advantage of the present invention, the rotation wheel is locked when the mounting seat is detached from the bracket, and is unlocked when the mounting seat is mounted on the bracket, such that the user only needs to directly disassemble and assemble the mounting seat so as to lock and unlock the rotation wheel, without having to manipulate the rotation wheel additionally, thereby facilitating the user locking and locking the rotation wheel.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
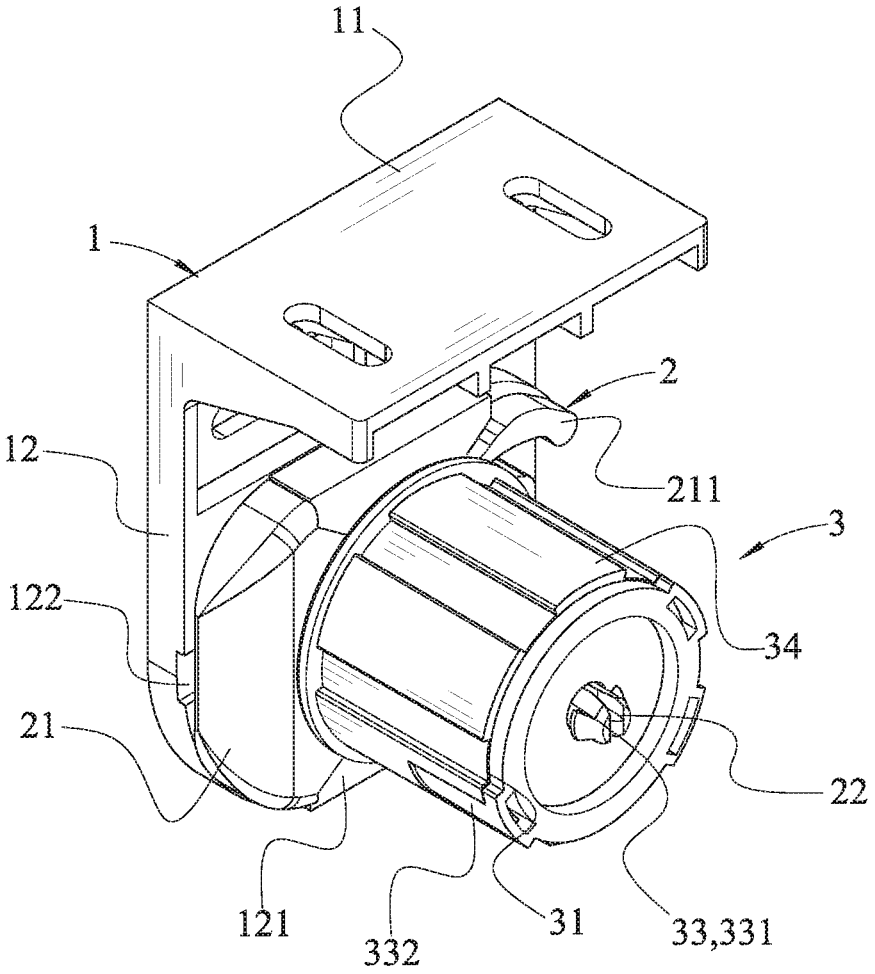
FIG. 1 is a perspective view of a stop structure for a cordless curtain in accordance with the preferred embodiment of the present invention.
Figure 2:
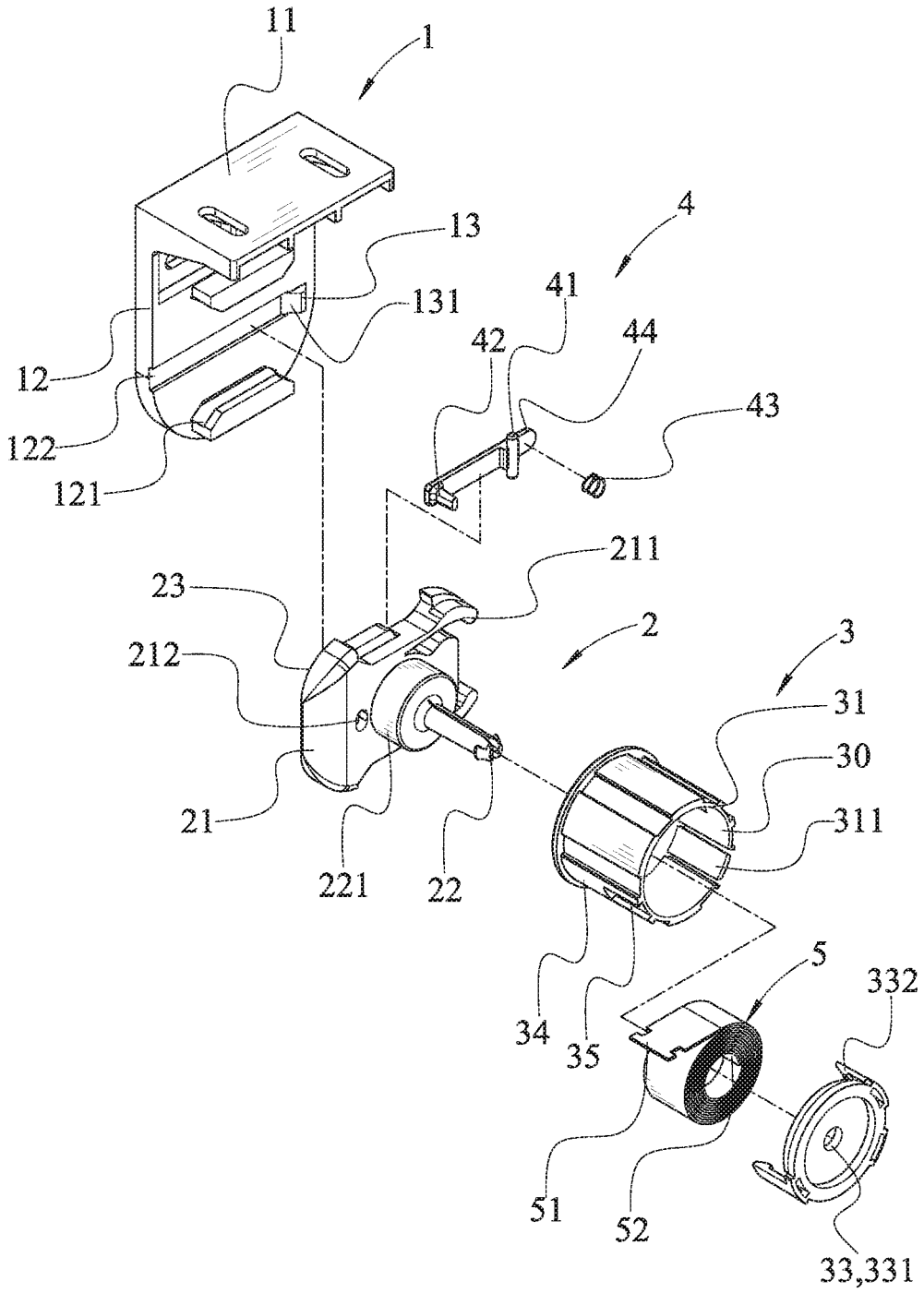
FIG. 2 is an exploded perspective view of the stop structure as shown in FIG. 1.
Figure 3:
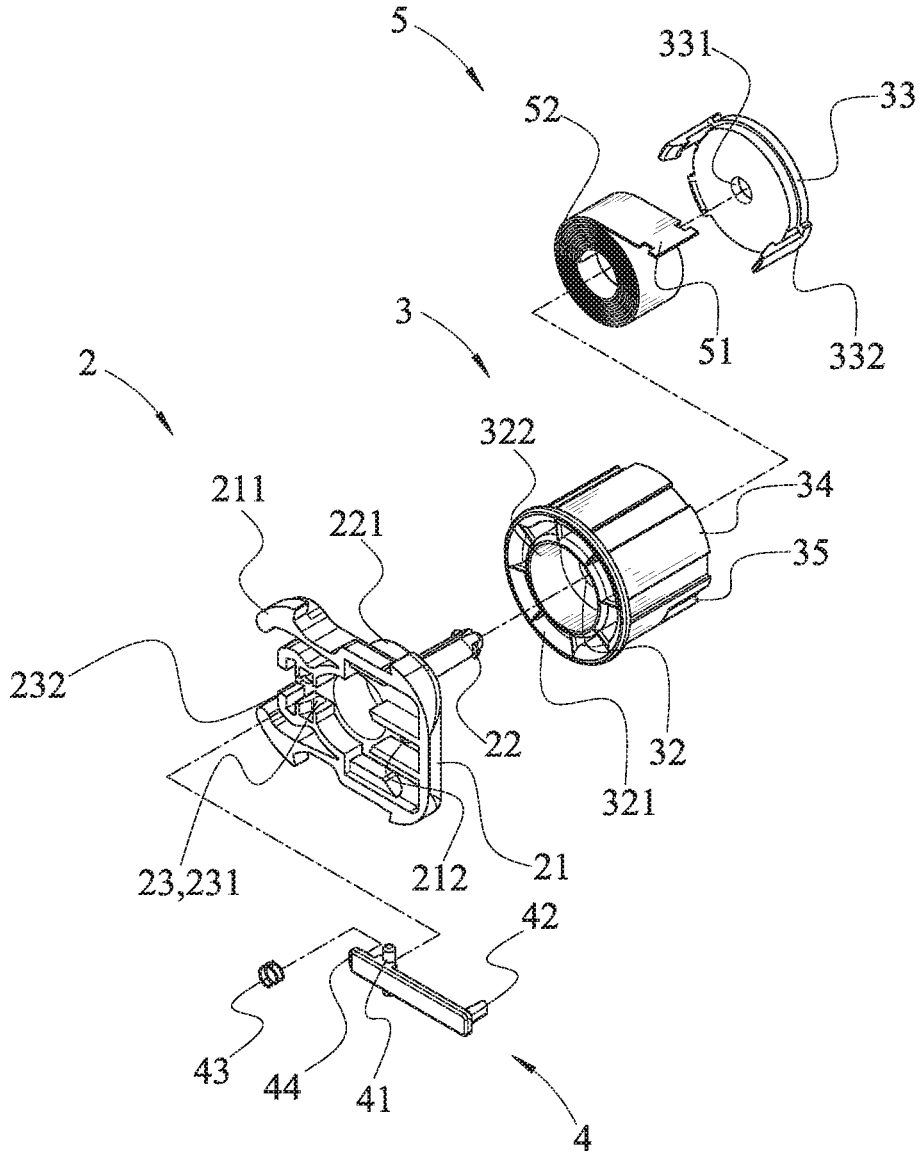
FIG. 3 is a partial exploded perspective view of the stop structure as shown in FIG. 1.
Figure 4:
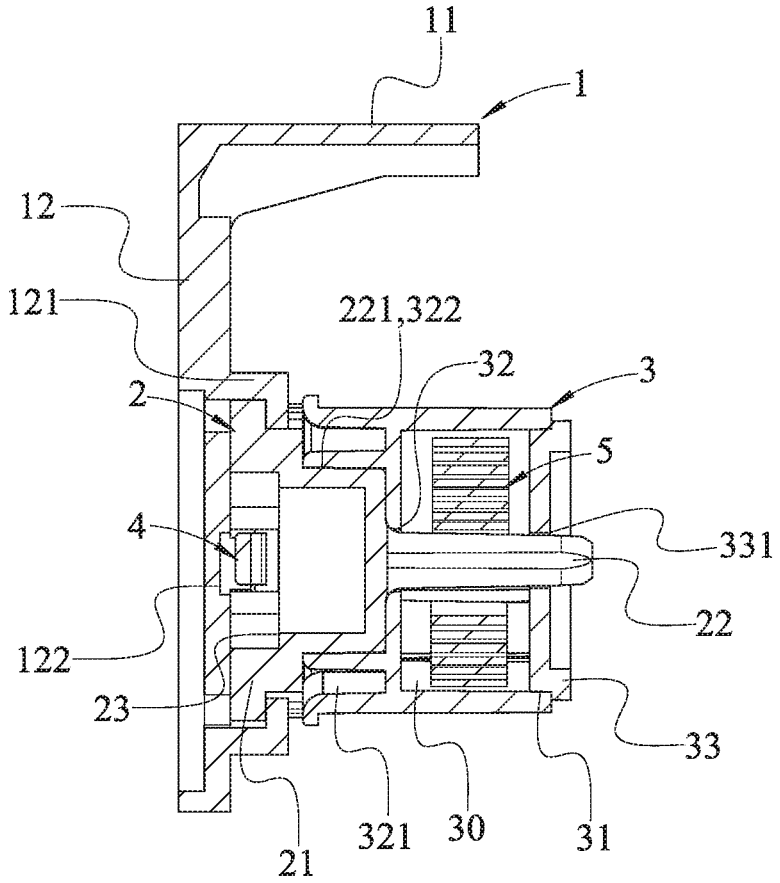
FIG. 4 is a cross-sectional view of the stop structure as shown in FIG. 1.

Referring to FIGS. 1-6, a spring stop structure for a cordless roller shade (or blind) in accordance with the preferred embodiment of the present invention comprises a bracket (or base) 1, a mounting seat 2 mounted on the bracket 1, a rotation wheel (or roller) 3 mounted on the mounting seat 2, a locking (or resting) piece 4 mounted on the mounting seat 2, and a spring 5 mounted on the rotation wheel 3.

The bracket 1 has a substantially L-shaped profile and includes a fitting portion 11, a first retaining portion 12, and a resting portion (or abutment) 13. The fitting portion 11 of the bracket 1 is affixed to a determined position of use. The first retaining portion 12 of the bracket 1 is provided with at least one first connecting end (or engagement) 121. The resting portion 13 of the bracket 1 is provided on the first retaining portion 12.

The mounting seat 2 is provided with a second retaining portion 21 corresponding to the first retaining portion 12 of the bracket 1. The second retaining portion 21 of the mounting seat 2 is provided with at least one second connecting end (or engagement) 211 corresponding to and connected with the first connecting end 121 of the bracket 1. The mounting seat 2 has a first face provided with an axle 22 and a second face provided with a receiving (or pressing or abutting) area 23. The receiving area 23 of the mounting seat 2 is provided with a shaft hole (or shaft connecting end) 231 and a recess 232.

The rotation wheel 3 is mounted on the axle 22 of the mounting seat 2. The rotation wheel 3 has a hollow shape and has an interior provided with a receiving space 30. The rotation wheel 3 has a first end provided with an opening 31 connected to the receiving space 30. The rotation wheel 3 is provided with a connecting area 311 which is formed on a peripheral wall of the receiving space 30 and extends to the opening 31. The rotation wheel 3 has a second end provided with an axle hole 32 and at least one positioning hole 321. The axle hole 32 of the rotation wheel 3 is mounted on the axle 22 of the mounting seat 2. The at least one positioning hole 321 of the rotation wheel 3 is located beside the axle hole 32.

The locking piece 4 has an elongate shape and is mounted on the receiving area 23 of the mounting seat 2. The locking piece 4 is provided with a shaft 41 rotatably mounted in the shaft hole 231 of the mounting seat 2. The locking piece 4 has a first end provided with a positioning projection 42 positioned in the at least one positioning hole 321 of the rotation wheel 3. A push member 43 is mounted in the recess 232 of the receiving area 23 of the mounting seat 2 and biased between a second end of the locking piece 4 and the mounting seat 2 to push the positioning projection 42 of the locking piece 4 toward the at least one positioning hole 321 of the rotation wheel 3. When the resting portion 13 of the bracket 1 presses the locking piece 4, the positioning projection 42 of the locking piece 4 is detached from the at least one positioning hole 321 of the rotation wheel 3.

The spring 5 is mounted in the receiving space 30 of the rotation wheel 3 and disposed at a winding state. The spring 5 has a first end (or an external end) provided with a first connecting portion 51 connected with (or secured to) the connecting area 311 of the rotation wheel 3 and a second end (or an internal end) provided with a second connecting portion 52 connected with (or secured to) the axle 22 of the mounting seat 2. Thus, when the rotation wheel 3 is rotated, the spring 5 is driven and rotated by the rotation wheel 3.

In the preferred embodiment of the present invention, the first retaining portion 12 of the bracket 1 is provided with a channel 122 connected to the resting portion 13. The channel 122 of the bracket 1 allows movement of the locking piece 4, such that the locking piece 4 is moved in the channel 122 of the bracket 1 to contact the resting portion 13 of the bracket 1.

In the preferred embodiment of the present invention, the second retaining portion 21 of the mounting seat 2 is provided with a through hole 212, and the positioning projection 42 of the locking piece 4 extends through the through hole 212 of the mounting seat 2 into the at least one positioning hole 321 of the rotation wheel 3.

In the preferred embodiment of the present invention, the axle 22 of the mounting seat 2 is provided with a steady axle end (or rotating support) 221, and the rotation wheel 3 is provided with a steady axle opening (or rotating support opening) 322 mounted on the steady axle end 221 of the mounting seat 2. The steady axle end 221 of the mounting seat 2 has a diameter greater than that of the axle 22. The steady axle opening 322 of the rotation wheel 3 is connected to the axle hole 32 and has a diameter flush with that of the steady axle end 221 of the mounting seat 2. Thus, the rotation wheel 3 is rotated relative to the mounting seat 2 smoothly and steadily by provision of the steady axle end 221.

In the preferred embodiment of the present invention, the steady axle end 221 of the mounting seat 2 is a bearing rotatably mounted on the axle 22. Thus, the steady axle end 221 of the mounting seat 2 reduces the friction and noise during rotation of the rotation wheel 3, and enhances revolving of the rotation wheel 3.

In the preferred embodiment of the present invention, a cap 33 is mounted on and covers the opening 31 of the rotation wheel 3. The cap 33 has a central position provided with a pivot hole 331. The axle 22 of the mounting seat 2 has a barbed (or hooked) front end extending through the pivot hole 331 of the cap 33 and hooked onto the cap 33. The front end of the axle 22 has a length greater than a width of the rotation wheel 3.

In the preferred embodiment of the present invention, the resting portion 13 of the bracket 1 is provided with a first ramp 131 connected to the channel 122, and the second end of the locking piece 4 is provided with a second ramp 44 pressing the first ramp 131 of the resting portion 13.

In practice, when the second ramp 44 of the locking piece 4 is pressed by the first ramp 131 of the resting portion 13, the shaft 41 of the locking piece 4 is rotated in the shaft hole 231 of the mounting seat 2, the push member 43 is compressed by the locking piece 4 to accumulate a restoring force, and the positioning projection 42 of the locking piece 4 is detached from the at least one positioning hole 321 of the rotation wheel 3. On the contrary, when the second ramp 44 of the locking piece 4 is detached from the first ramp 131 of the resting portion 13, the locking piece 4 is pushed by the restoring force of the push member 43, such that the shaft 41 of the locking piece 4 is rotated in the shaft hole 231 of the mounting seat 2, and the positioning projection 42 of the locking piece 4 is locked in the at least one positioning hole 321 of the rotation wheel 3.

In the preferred embodiment of the present invention, the rotation wheel 3 has an outer edge provided with a plurality of protrusions 34 connected with a curtain pole (or shaft or tube or rod). Preferably, the protrusions 34 of the rotation wheel 3 are closely fitted into the curtain pole.

In the preferred embodiment of the present invention, the rotation wheel 3 has an outer edge provided with a plurality of slots 35, and the cap 33 is provided with two hooked portions 332 hooked on the slots 35 of the rotation wheel 3.

In the preferred embodiment of the present invention, the push member 43 is an elastic member such as a spring. Alternatively, the push member 43 is operated by a magnetic force.

In the preferred embodiment of the present invention, the spring 5 is a spiral elastic plate, a volute spiral blade, a helical spring, a coil spring or the like.

In the preferred embodiment of the present invention, the second retaining portion 21 of the mounting seat 2 is connected with the first retaining portion 12 of the bracket 1 by snap-fit, insertion, tenon-and-mortise connection or locking.

In assembly, the fitting portion 11 of the bracket 1 is affixed to a determined mounting position, such as a frame of a window, a holder of a curtain or the like. Then, the protrusions 34 of the rotation wheel 3 are closely fitted into the curtain pole. Then, the second retaining portion 21 of the mounting seat 2 is attached to and connected with the first retaining portion 12 of the bracket 1. At this time, when the second retaining portion 21 of the mounting seat 2 is inserted into the first retaining portion 12 of the bracket 1, the second ramp 44 of the locking piece 4 is pressed by the first ramp 131 of the resting portion 13, such that the shaft 41 of the locking piece 4 is rotated in the shaft hole 231 of the mounting seat 2, the push member 43 is compressed by the locking piece 4, and the positioning projection 42 of the locking piece 4 is detached from the at least one positioning hole 321 of the rotation wheel 3. Thus, the rotation wheel 3 is rotated freely.

Figure 5:
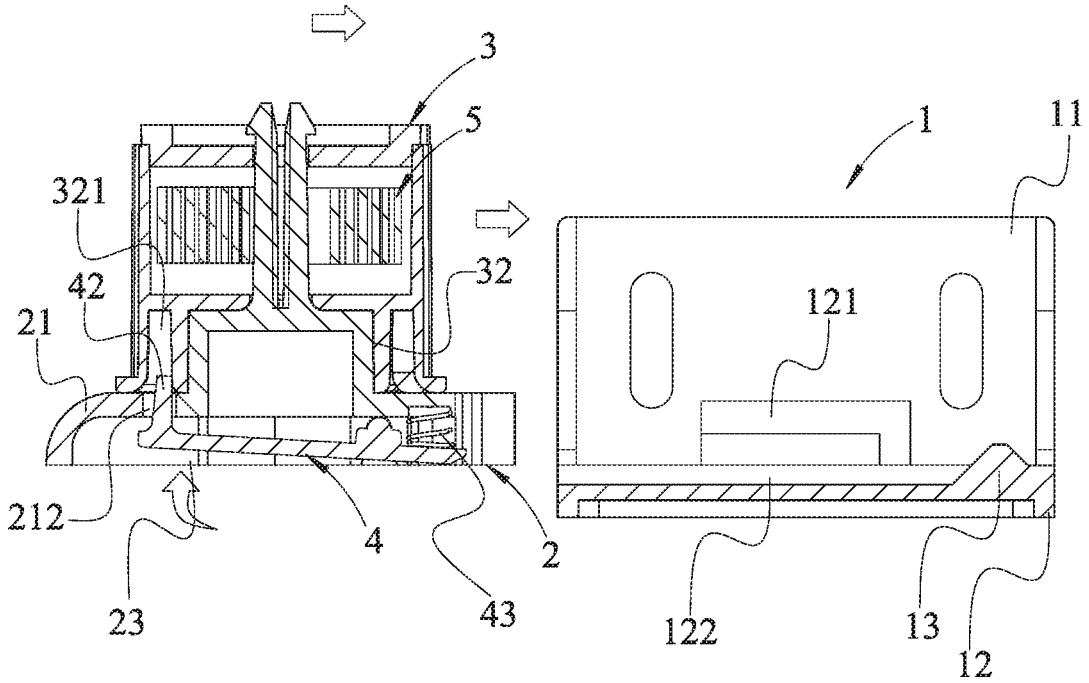
FIG. 5 is a partial exploded cross-sectional view of the stop structure in accordance with the preferred embodiment of the present invention.

After the second retaining portion 21 of the mounting seat 2 is detached from the first retaining portion 12 of the bracket 1, the second ramp 44 of the locking piece 4 is detached and released from the first ramp 131 of the resting portion 13, such that the locking piece 4 is pushed by the restoring force of the push member 43 and is pivoted relative to the mounting seat 2. In such a manner, the shaft 41 of the locking piece 4 is rotated in the shaft hole 231 of the mounting seat 2, and the positioning projection 42 of the locking piece 4 extends through the through hole 212 of the mounting seat 2 and is locked in the at least one positioning hole 321 of the rotation wheel 3 as shown in FIG. 5, such that the rotation wheel 3 is locked by the locking piece 4 and cannot be rotated relative to the mounting seat 2 by the elastic force of the spring 5. Thus, the spring 5 will not become loosened when the mounting seat 2 is detached from the bracket 1, such that it is unnecessary to tighten and regulate the tension of the spring 5 when the mounting seat 2 is mounted on the bracket 1 again, and unnecessary to calculate the tension of the spring 5 when the spring 5 is tightened.

Figure 6:
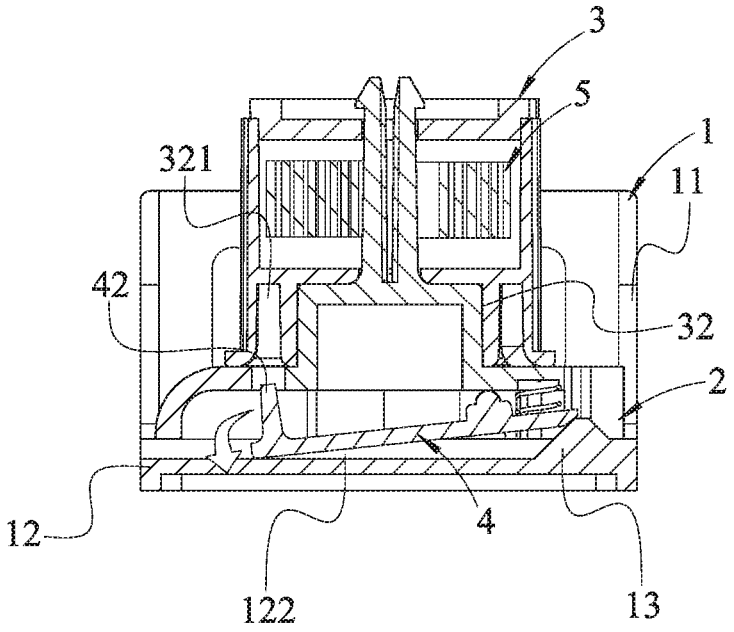
FIG. 6 is a cross-sectional assembly view of the stop structure as shown in FIG. 5.

When the second retaining portion 21 of the mounting seat 2 is inserted into the first retaining portion 12 of the bracket 1 after cleaning of the curtain, the second ramp 44 of the locking piece 4 is pressed by the first ramp 131 of the resting portion 13, such that the shaft 41 of the locking piece 4 is rotated in the shaft hole 231 of the mounting seat 2, the push member 43 is compressed by the locking piece 4, and the positioning projection 42 of the locking piece 4 is detached from the at least one positioning hole 321 of the rotation wheel 3 as shown in FIG. 6. Thus, the rotation wheel 3 is rotated freely.

Accordingly, the rotation wheel 3 is locked automatically when the mounting seat 2 is detached from the bracket 1, to prevent the rotation wheel 3 from being rotated, and to prevent the spring 5 from becoming loosened when the cordless roller shade is disassembled, such that it is unnecessary to tighten and regulate the tension of the spring 5 when the mounting seat 2 is mounted on the bracket 1 again. In addition, the rotation wheel 3 is locked when the mounting seat 2 is detached from the bracket 1, and is unlocked when the mounting seat 2 is mounted on the bracket 1, such that the user only needs to directly disassemble and assemble the mounting seat 2 so as to lock and unlock the rotation wheel 3, without having to manipulate the rotation wheel 3 additionally, thereby facilitating the user locking and locking the rotation wheel 3.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A stop structure comprising:

a bracket;

a mounting seat mounted on the bracket;

a rotation wheel mounted on the mounting seat;

a locking piece mounted on the mounting seat; and a spring mounted on the rotation wheel;

wherein:

the bracket includes a fitting portion, a first retaining portion, and a resting portion;

the first retaining portion of the bracket is provided with at least one first connecting end;

the mounting seat is provided with a second retaining portion corresponding to the first retaining portion of the bracket;

the second retaining portion of the mounting seat is provided with at least one second connecting end corresponding to and connected with the first connecting end of the bracket;

the mounting seat has a first face provided with an axle and a second face provided with a receiving area;

the receiving area of the mounting seat is provided with a shaft hole and a recess;

the rotation wheel is mounted on the axle of the mounting seat;

the rotation wheel has an interior provided with a receiving space;

the rotation wheel has a first end provided with an opening connected to the receiving space;

the rotation wheel is provided with a connecting area;

the rotation wheel has a second end provided with an axle hole and at least one positioning hole;

the axle hole of the rotation wheel is mounted on the axle of the mounting seat;

the locking piece is mounted on the receiving area of the mounting seat;

the locking piece is provided with a shaft rotatably mounted in the shaft hole of the mounting seat;

the locking piece has a first end provided with a positioning projection positioned in the at least one positioning hole of the rotation wheel;

a push member is mounted in the recess of the mounting seat and biased between a second end of the locking piece and the mounting seat;

when the resting portion of the bracket presses the locking piece, the positioning projection of the locking piece is detached from the at least one positioning hole of the rotation wheel;

the spring is mounted in the receiving space of the rotation wheel; and the spring has a first end provided with a first connecting portion connected with the connecting area of the rotation wheel and a second end provided with a second connecting portion connected with the axle of the mounting seat.

2. The stop structure of claim 1, wherein the first retaining portion of the bracket is provided with a channel connected to the resting portion.

3. The stop structure of claim 1, wherein the second retaining portion of the mounting seat is provided with a through hole, and the positioning projection of the locking piece extends through the through hole of the mounting seat into the at least one positioning hole of the rotation wheel.

4. The stop structure of claim 1, wherein;

the axle of the mounting seat is provided with a steady axle end;

the rotation wheel is provided with a steady axle opening mounted on the steady axle end of the mounting seat;

the steady axle end of the mounting seat has a diameter greater than that of the axle; and the steady axle opening of the rotation wheel is connected to the axle hole.

5. The stop structure of claim 4, wherein the steady axle end of the mounting seat is a bearing rotatably mounted on the axle.

6. The stop structure of claim 1, wherein:

a cap is mounted on and covers the opening of the rotation wheel;

the cap has a central position provided with a pivot hole; and the axle of the mounting seat has a barbed front end extending through the pivot hole of the cap and hooked onto the cap.

7. The stop structure of claim 2, wherein the resting portion of the bracket is provided with a first ramp connected to the channel, and the second end of the locking piece is provided with a second ramp pressing the first ramp of the resting portion.

8. The stop structure of claim 1, wherein the rotation wheel has an outer edge provided with a plurality of protrusions.

9. The stop structure of claim 6, wherein the rotation wheel has an outer edge provided with a plurality of slots, and the cap is provided with two hooked portions hooked on the slots of the rotation wheel.

10. The stop structure of claim 1, wherein the push member is a spring or operated by a magnetic force.

* * * * *